United States Patent [19]

Marcus et al.

[11] Patent Number: 4,823,513

[45] Date of Patent: Apr. 25, 1989

[54] APPARATUS AND PROCESS FOR VIBRATORY FINISHING OF PARTS

[75] Inventors: R. Steven Marcus, Columbus, Ohio; Richard N. Mercurio, Carmel, Ind.

[73] Assignee: Mermark, Inc., Carmel, Ind.

[21] Appl. No.: 108,266

[22] Filed: Oct. 13, 1987

[51] Int. Cl.[4] ..... B24B 31/00

[52] U.S. Cl. ..... 51/7; 51/317; 134/1; 134/184; 366/118; 366/123

[58] Field of Search ..... 51/6, 7, 17, 317; 134/1, 184; 366/118, 123

[56] References Cited

U.S. PATENT DOCUMENTS

| | | | |
|---|---|---|---|
| 2,860,646 | 11/1958 | Zucker | 134/1 X |
| 3,581,440 | 6/1971 | McKinney et al. | 51/7 |
| 3,957,252 | 5/1976 | Storz | 134/184 X |
| 4,526,049 | 7/1985 | Pottgens | 366/123 X |
| 4,581,853 | 4/1986 | Marcus | 51/7 |
| 4,752,137 | 6/1988 | Mor*acu/e/ n* | *366/123* |

FOREIGN PATENT DOCUMENTS

| | | | |
|---|---|---|---|
| 103267 | 8/1979 | Japan | 134/184 |
| 799940 | 1/1981 | U.S.S.R. | 51/7 |

*Primary Examiner*—Robert P. Olszewski
*Attorney, Agent, or Firm*—T. Gene Dillahunty

[57] ABSTRACT

This invention provides apparatus and processes for vibratory finishing of parts wherein the parts are attached to a vibrating head which has internal vibrating mechanism and mechanism for transmitting power to the vibrating mechanism in the vibrating head, then the vibrating head with the parts attached is submerged in the media and the parts vibrated to accomplish the desired finishing. This invention eliminates the necessity for any portion of the vibratory finishing apparatus to vibrate except for that portion which is submerged in the media, namely the vibrating head and attached parts, which is submerged in the media. The finishing provided by this invention is fast, quiet, efficient, effective and versatile.

8 Claims, 1 Drawing Sheet

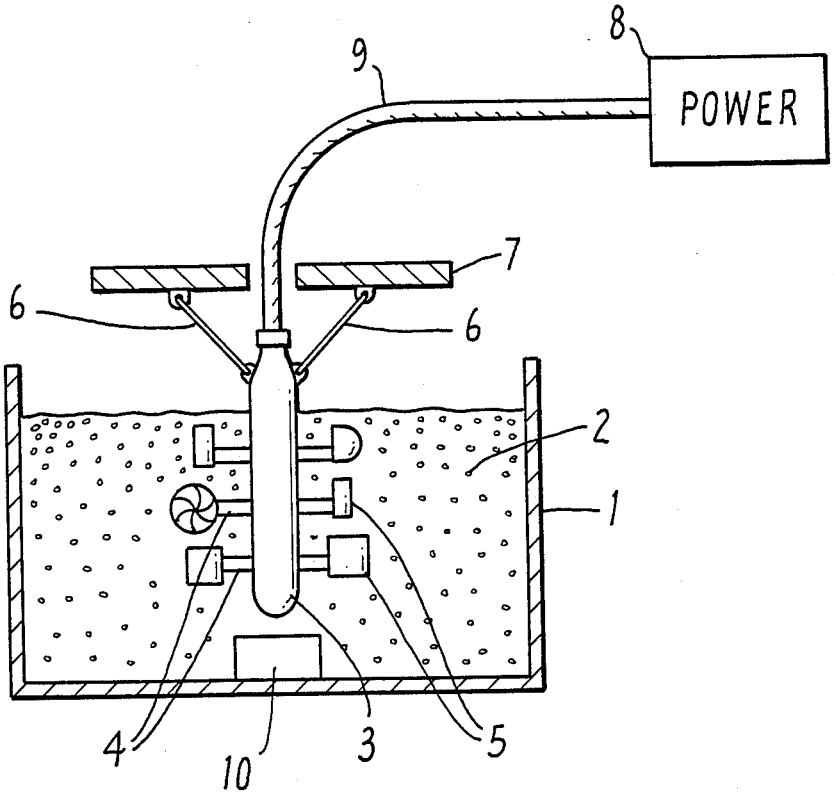
8
9
POWER
7
6
6
2
1
4
10
3
5

APPARATUS AND PROCESS FOR VIBRATORY FINISHING OF PARTS

FIELD OF THE INVENTION

This invention relates to apparatus and process for finishing preformed parts by vibrating the parts in an abrasive media.

BACKGROUND OF THE INVENTION

Finishing of preformed parts such as metal castings has been done by vibrating the parts while submerged in an abrasive media, which is generally known as "vibratory finishing". The various vibratory finishing processes have been used to clean foundry mold sand and other materials from the surfaces of parts, remove casting fins, remove machining burrs, remove rust and other oxides and polish the exterior as well as interior surfaces of the parts. Finishing the internal surfaces of parts is more difficult than finishing the external surfaces and more time consuming.

Vibratory finishing has been carried out by using resonant vibration, which is usually at a high frequency vibration, as exemplified by U.S. Pat. No. 3,581,440 to McKinney, and by lower frequency, nonresonant vibration, as exemplified by U.S. Pat. No. 4,581,853 to Marcus. The disclosures of these patents are incorporated herein by reference.

The resonant vibratory finishing is efficient in a limited range of operation which largely depends on the characteristics of the resonating member in the equipment and on the combination thereof with the mass of the parts attached to the resonating member. The equipment is usually large and heavy compared to the parts being finished, requires heavy duty motors to power the resonating member and has little flexibility of operating ranges.

The nonresonant vibratory finishing is more flexible in its range of operation and in the types and sizes of parts which can be finished on a given piece of equipment. The lower frequency operation is quieter, has lower power requirements and can use lighter weight apparatus components. In addition, the free-moving vibrating member provides more flexibility and productivity for attaching parts at more points along the vibrating member.

In the above processes it is frequently desired to enhance the vibratory finishing by not only vibrating the parts in the finishing media, but to also vibrate the media as well by vibrating the container holding the media.

It is an object of this invention to provide more efficient apparatus and processes for finishing of parts.

It is another object of this invention to provide vibratory finishing apparatus which is smaller, more flexible and adaptable in use and has lower power requirements for finishing given parts.

It is another object of this invention to provide vibratory finishing processes which are more efficient, quieter in operation and provide faster finishing of given parts.

Other objects and advantages of the present invention will be apparent to those skilled in the art.

SUMMARY OF THE INVENTION

In one aspect this invention provides apparatus for finishing preformed parts in finishing media comprising:

a container for the media;

a vibrating head which:

(a) has means on the exterior thereof for attaching the parts to the head whereby the parts are vibrated when the head vibrates; and (b) has internal means for vibrating the head; and means for introducing the head into the container to submerge at least part of the head and the attached parts in the media and for removing the head and attached parts from the media; and means for transmitting power to the internal vibrating means in the vibrating head.

In another aspect this invention provides a process for finishing preformed parts in finishing media comprising:

attaching the parts to a vibrating head having internal means for vibrating the head and the parts;

submerging at least part of the vibrating head and the attached parts to be finished into the media; and providing power to the internal means for vibrating the head, whereby the vibrating head and attached parts are vibrated while submerged in the media to thereby finish the parts.

BRIEF DESCRIPTION OF THE DRAWING

The drawing is a side elevation partially in section of a preferred apparatus of this invention.

DESCRIPTION OF THE INVENTION

This invention provides unique, efficient and simple apparatus and processes for internal and external vibratory finishing of parts. Conventional vibratory finishing involves attaching the parts to a vibrating member, such as a beam, bar or resonating member, then submerging the parts in an abrasive media and vibrating said beam, bar or member in order to vibrate the parts in the media. The vibrating member and means for powering the vibrating member remain outside the media while the parts are submerged in the media. In contrast thereto, we now have found tremendous advantages can be achieved in vibratory finishing by adapting the vibrating member so that it contains its own internal means for vibrating the member and so that it can be submerged into the media along with parts attached to it. In the description and claims regarding this invention, this aspect of the invention is referred to as the "vibrating head".

The vibrating head of this invention provides the desired vibration energy directly to the parts in a very effecient way because of the close proximity of the parts and the vibrating means. Due to this relationship provided by this invention it is not necessary for any portion of the apparatus outside the media to vibrate, i.e., this invention enables one to confine all the vibration energy within the finishing media at the vibrating head and parts. Consequently, this invention provides a number of advantages over conventional vibratory finishing, including greatly reduced energy requirements for given production, and greatly reduced noise levels and improved worker conditions, because nothing outside the media need vibrate. Other advantages over conventional vibratory processing include increased productivity due to greatly reduced finishing times and increased number of parts that can be processed per processing cycle, better quality finishing, internal finishing of parts that cannot be internally finished by conventional vibratory finishing, reduced equipment maintenance due to less equipment vibration, reduced capital investment due to smaller equipment requirements for given production requirements, elimination of the need to separately vibrate the media by vibrating the media container, as well as numerous other advantages which will be apparent to those skilled in the art of vibratory finishing when practicing this invention.

The basic apparatus of this invention can be illustrated by reference to a preferred embodiment shown in the drawing. Media container 1 holds abrasive finishing media 2, and usually a liquid medium such as water in which the media can move and vibrate easily. The liquid medium usually contains various conventional additives for lubricity and the like, which additives are commercially available from the suppliers of the vibratory finishing media. The liquid medium also usually flows through the container and the media at a desired rate to carry away the particles and materials removed from the parts during finishing. Vibrating head 3 has means 4 on the exterior thereof for attaching parts 5 which are to be finished by vibrating them in the media.

Vibrating head 3 is supported preferrably by flexible support means 6, which is connected to member 7 for raising and lowering the vibrating head 3 and attached parts 5 out of and into, respectively, the finishing media. While support means 6 could be rigid, a flexible support means is preferred so that the vibrating head 3 can "float" somewhat freely in the media while vibrating and so that little, if any, vibration energy is transmitted to member 7. The less energy that is transmitted to member 7, the more energy that is usable to vibrate and finish parts 5 and the quieter the apparatus will run when no portion of the apparatus, such as member 7, vibrates outside the media.

Vibrating head 3 is connected to power source 8 by flexible power transmission means 9. Again, the power transmission means 9 could be a rigid member, but it is preferred that it be flexible so that vibration energy from vibrating head 3 is not transmitted out of the media to other portions of the apparatus, such as support member 7 or power source 8.

Other optional and preferred features and modifications of the apparatus of this invention will be apparent to those skilled in the art, particularly in various commercial applications and uses for different parts, media, types of finishing, etc. For example, vibrating head 3 may be supported, at least partially, by a resilient support means, such as rubber, as illustrated by suppors means 10 in FIG. 1.

The vibrating head useful in this invention can be any configuration which contains internal means for vibrating itself while at least partially submerged in the media and which has means for attaching the parts whereby the parts are vibrated when the head vibrates. "Internal" in this context means that the vibrating means is incorporated with or attached to the vibrating head and is at least partially submerged in the media with the vibrating head when in use, and is preferrably inside the vibrating head but may be outside and attached to the vibrating head.

One configuration of vibrating head preferred in the present invention has the same internal construction as commercially available concrete internal vibrators, which are used in freshly poured concrete to consolidate, compact and remove air from the concrete before it sets. To make this type of vibrator useful as a vibrating head in the present invention, it is necessary to provide means on the exterior of the vibrator for attaching the parts to be finished and provide means for lowering and raising the vibrating head into and out of the media with the parts attached to it. One source of such concrete internal vibrators is Wacker Corporation, Milwaukee, Wis. 53209.

A preferred type of vibrating head contains an eccentrically rotatable mass. Other types of mechanical or electrical vibrating means can be used, such as reciprocating mechanisims of various kinds. When the eccentrically rotatable mass is used, the power for rotating the mass is preferrably supplied by a flexible shaft, such as those commercially available in connection with the concrete internal vibrators mentioned above. While a rigid shaft can be used, the flexible shaft is preferred for the reasons discussed above relative to preventing or reducing vibration of other portions of the apparatus outside the media. The power can be supplied to the flexible shaft by electric, gasoline or other type motor. In another form the vibrating head may contain an internal electric, pneumatic, hydraulic or other type motor adjacent to or as part of the rotatable mass. In this configuration, it is only necessary to supply the electric pneumatic, hydraulic or other type power to the motor inside the vibrating head by means of insulated electric conductors or conduits connected to an appropriate power source and to the motor. In any of these configurations, the means for transmitting power to the vibrating head, whether it is the rigid shaft, the flexible shaft, the electrical conductors or other means, can also serve as the support means for the vibrating head and attached parts, eliminating the need for the separate support means 6 in the drawing. In such a case the power source 8 could be attached directly to member 7 for raising and lowering vibrating head 3.

The vibrating head useful in this invention may vibrate about only one axis or may vibrate about two or more axes, or may vibrate in a single plane or in two or more planes, depending on the parts to be finished, the media, the materials of the parts and other factors which will be apparent to one skilled in the art of vibratory finishing. Two or more vibrating heads can also be connected together in various configurations in order to achieve any particularly desired patern, amplitude or power of vibration for a particular application.

In addition to a flexible support means for the vibrating head and attached parts, it is sometimes preferrable to also have guide means for keeping the vibrating head and attached parts in the desired position in the media while the parts are being vibrated. This may be necessary in some cases to prevent the parts from contacting the sides or bottom of the media container during finishing.

While it is preferred to attach the parts directly to the vibrating head, the parts can be carried by some other structure which is vibrated by the vibrating head in order to vibrate the parts in the media. For example, the vibrating head can be positioned in the media and interchangable racks of parts can be lowered into the media and clamped to the vibrating head then unclamped and raised out of the media when finished, leaving the vibrating head in place. Other configurations will be apparent to those skilled in the art following the present disclosure.

This invention is useful in finishing any kind of parts, including cast, forged, stamped or machined metal or powdered metal parts; cast, injection molded, stamped or machined plastic parts; sawed, machined or laminated wood parts; molded or laminated wood particle parts; ceramic, glass or similar parts; and other parts or pieces on which some form of surface or structural finishing can be accomplished by vibratory finishing. The particular media used, the power, amplitude and frequency of the vibration and the length of time of processing will each vary depending on the particular shape, hardness and surface characteristics of the metal, plastic, wood, ceramic or other parts, as well as the desired finishing to be accomplished for each part. This invention provides the ease of control and flexibility for accommodating a wide variety of parts, media and process conditions.

The term "finishing" as used in the description of and claims for the present invention means any change in the surface or structural characteristics of a part that can be accomplished by vibratory finishing. Typically vibratory finishing is used to remove flashings from cast or forged metal parts, to remove foundry mold sand from cast metal parts, to remove machining burrs from machined metal parts, to give a matte or textured finish to the surface of metal parts, to remove rust, corrosion or scale from metal parts, and for other purposes. Vibratory finishing is used to similarly finish the internal areas of metal parts. The apparatus and processes of this invention not only are superior in said applications, particularly in the internal finishing, they also can be used for similar purposes for plastic parts, to sand or texture wood parts, to finish, deflash, smooth or texture ceramic parts, and for other applications where conventional vibratory finishing apparatus and processes have had poor results or have not been useful at all.

The finishing media useful in this invention, as well as the liquid medium and various additives used therein, are those conventionally used in vibratory finishing. The media may be abrasive in nature or non-abrasive, may be of any particle or piece size and may be of any particular shape, all as desired for the particular size, shape and material of the parts being finished. Many of the conventional media are ceramic type materials, such as fused aluminum oxide. However, due to the wide applicability and adaptability of this invention, various other types of media, such as metal or plastic, and other non-conventional liquid mediums and additive materials will be found useful in various finishing operations. Likewise, the containers for the media useful in this invention are conventional and the selection thereof will be apparent to one skilled in the art following the teachings of this disclosure. As noted above it is not necessarily desirable to vibrate the media container when using this invention, but it may be vibrated if desired for a particular application.

The vibrating head of the present invention can be used effectively at conventional vibratory finishing frequencies or speeds, for example at the 4,000 to 8,000 vibrations per minute used in the resonant vibratory finishing or at the lower frequencies used in the nonresonant vibratory finishing. However, it has been found also that the vibrating head of the present invention is particularly effective in many applications at higher frequencies in the range of about 8,000 to about 18,000 and particularly in the range of about 10,000 to about 15,000 vibrations per minute. The particular frequency which is most effective will depend on the particular parts being finished, the media used and the amplitude of the vibration used.

The amplitude of the vibration useful in this invention likewise may be in the same ranges used in conventional vibratory finishing, but it has been found that effective finishing is achieved with this invention at low amplitudes, particularly when the higher frequencies mentioned above are used. In this invention the amplitude in part will be controled by the ratio of the mass of the vibrating means in the vibrating head, such as an eccectrically rotatable mass, and the mass of the parts attached to the vibrating head for finishing. The selection of this ratio, the mass of the vibrating means and consequently the amplitude for a particular finishing process using this invention will be well within the skill of one practicing the vibratory finishing art when following the teachings of the present disclosure.

In the practice of this invention, it is in many applications preferred to vibrate the parts while submerging them into the media and continue to vibrate the parts while removing them from the media in order to allow the media pieces or particles to find their way out of the internal passages of the parts. The speed or frequency used while submerging the parts into or removing the parts from the media may be higher or lower than the speed or frequency used for finishing or processing the parts. Similarly, the amplitude of vibration during submersion or removal may be varied. The actual speed or frequency and amplitude for aiding in submersing the parts and vibrating head into the media and for removing the media from the parts when the parts are raised out of the media will depend on the media shape and density, any liquid medium and additive materials present, and the size and shape of the parts. In many applications it is also desirable to wash or rinse the parts as they are vibrated and removed from the media to aid in the removal of media, particles and solutions from the parts, particularly the internal areas of the parts. The parts can be submerged in the media by lowering the head and the attached parts into the media, by raising the media container or by any combination thereof.

One of the very significant advantages of the apparatus and processes of the present invention is the greatly reduced processing time required to achieve a given finish on a given part compared to conventional vibratory finishing apparatus and processes. In many applications the parts are finished with the present invention in less than 1/10th time required for conventional processing; in other applications the parts are finished with this invention in less than 1/100th the conventional time; and for other parts this invention provides internal finishing in equally short times where conventional vibratory finishing cannot provide any internal finishing regardless of time.

EXAMPLES

In the following examples the parts were attached to a vibrating head which was a modified WYCO Tool Co., Racine, Wisc. vibrator head model 993 square head weighing about 7.5 lbs. and measuring about 2 in. square and about 12 in. in length. The power was a WYCO 3 hp electric motor connected to the vibrator head with a WYCO flexible shaft 2 ft. length. In each of these tests the parts were attached to the vibrating head with hose clamps or cinch blocks. The media was in a 5 gallon container, and was 12 in. deep. The media was crushed, fused aluminum oxide media #12, in water which contained conventional lubricity and other additives, which was flowed through the container at a rate of 30 gph. The vibrating head was run at 16,000 rpm while lowering the parts into the media; at 13,000 rpm while processing the parts in the media for the stated processing time; and at 16,000 rpm while raising the parts out of the media.

Example 1

A die cast aluminum intake manifold port for refrigeration compressor having numerous internal ports and drilled holes, plus machined surfaces and seal grooves and requiring deburring and surface finishing was processed for 1 minute. All visible internal and external burrs were removed; all outside surfaces were finished to a uniform matte finish; almost all directional grinding lines were removed; and internal and external edges were radiused to about 0.010–0.015 in. It is estimated that approximately 45 minutes would be required in conventional vibratory finishing process for comparable external results with little or no internal finishing.

Example 2

A high density powdered iron part (approx. 7.3 g/cu.cm.) having ground surfaces and ring grooves and requiring a break of all sharp edges and removal of all burrs, particularly within the ring grooves was processed for 30 seconds. All surfaces were finished to a matte finish, all edges were broken to a 0.008–0.012 in. radius and all burrs were removed. It is estimated that approximately one hour would be required in conventional vibratory finishing process for comparable results.

Example 3

A mild steel part, sheared from 0.32 in. stock, having ¾ in. holes blanked through in several areas and requiring removal of burrs from the hole ID's and slightly dreaking the edges was processed for 14 seconds (at which time the fixture broke). All burrs were removed and the edges broken 0.003 to 0.005 in. It is estimated that conventional vibratory finishing process for comparable results would be approximately 45 minutes.

Example 4

A hardened steel (60 Rc+) hydraulic piston having 0.050 hole drilled through the top into 0.375 in. diameter×1.75 in. deep interior bore and requiring removal of interior burrs was processed for 1 minute. All burrs were removed and all surfaces, interior and exterior received a uniform, matte finish. This part cannot be finished with conventional vibratory finishing; it would require thermal/explosive deburring or abrasive putty deburring.

Example 5

Scissor blades, which were hardened and ground, and requiring the removal of the grinding lines were processed for two minutes. All grind lines were removed and the blades received a matte finish over all surfaces. It is estimated that conventional vibratory finishing would require approxomately 12 hours for comparable results.

Example 6

A test block of alloy 52100 steel, hardened and ground to a pattern of grooves and raised pads was processed for two minutes for the purpose of measuring the edge break along the grooves. The edge break was 0.0012×0.0025 in. On an identical test block processed by conventional vibratory finishing the edge break was 0.0005×0.0025 in. after 30 minutes and approximately 0.0015×0.0015 in. after 1 hour.

We claim:

1. Apparatus for finishing preformed parts in finishing media comprising:

a container for the media;

a vibrating head which:

(a) has means on the exterior thereof for attaching the parts to the head whereby the parts are vibrated when the head vibrates; and (b) has internal means for vibrating the head; and means for introducing the head into the container to submerge at least part of the head and the attached parts in the media and for removing the head and attached parts from the media; and means for transmitting power to the internal vibrating means in the vibrating head.

2. Apparatus according to claim 1 wherein the internal means for vibrating the head comprises an eccentrically rotatable mass and the means for transmitting power to the internal vibrating means comprises a shaft connected to a motor at one end and to the rotatable mass at the other end.

3. Apparatus according to claim 2 wherein the shaft is flexible.

4. Apparatus according to claim 1 wherein the internal means for vibrating the head comprises a motor and an eccentrically rotatable mass and the means for transmitting power to the internal vibrating means comprises insulated electric conductors or conduits connected to the motor.

5. A process for finishing preformed parts in finishing media comprising:

attaching the parts to a vibrating head having internal means for vibrating the head and the parts;

submerging at least part of the vibrating head and the attached parts to be finished into the media; and providing power to the internal means for vibrating the head, whereby the vibrating head and attached parts are vibrated while submerged in the media to thereby finish the parts.

6. A process according to claim 5 comprising vibrating the parts while submerging them into the media.

7. A process according to claim 5 comprising vibrating the parts while removing them from the media.

8. A process according to claim 6 comprising vibrating the parts while removing them from the media.

* * * * *